US010074262B2

(12) United States Patent
Findlay et al.

(10) Patent No.: US 10,074,262 B2
(45) Date of Patent: Sep. 11, 2018

(54) DETERMINING ENTRY INTO OR EXIT FROM A PLACE WHILE A TRACKING DEVICE IS IN THE PLACE

(71) Applicant: BUDDI LIMITED, Rickmansworth, Hertfordshire (GB)

(72) Inventors: Ewan Findlay, Milnathort (GB); Sara Murray, Rickmansworth (GB)

(73) Assignee: BUDDI LIMITED, Rickmansworth, Hertfordshire (GB)

( * ) Notice: Subject to any disclaimer, the term of this patent is extended or adjusted under 35 U.S.C. 154(b) by 0 days.

(21) Appl. No.: 15/540,020

(22) PCT Filed: Jan. 8, 2016

(86) PCT No.: PCT/GB2016/050040
§ 371 (c)(1),
(2) Date: Jun. 26, 2017

(87) PCT Pub. No.: WO2016/110710
PCT Pub. Date: Jul. 14, 2016

(65) Prior Publication Data

US 2018/0018865 A1 Jan. 18, 2018

(30) Foreign Application Priority Data

Jan. 9, 2015 (GB) ..... 1500358.5

(51) Int. Cl.
*G08B 1/08* (2006.01)
*G08B 21/22* (2006.01)
(Continued)

(52) U.S. Cl.
CPC ..... *G08B 21/22* (2013.01); *G08B 25/10* (2013.01); *G08B 21/043* (2013.01); *G08B 29/185* (2013.01)

(58) Field of Classification Search
CPC ..... G08B 21/043; G08B 21/22; G08B 25/10; G08B 29/185
(Continued)

(56) References Cited

U.S. PATENT DOCUMENTS

2003/0030568 A1* 2/2003 Lastinger ..... G06K 7/0008 340/8.1
2009/0102642 A1* 4/2009 Huseth ..... G01S 5/14 340/539.13
(Continued)

FOREIGN PATENT DOCUMENTS

CN 103 258 408 A 8/2013
CN 103 745 574 A 4/2014
(Continued)

OTHER PUBLICATIONS

Combined Search and Examination Report dated Jun. 30, 2015 from related Great Britain Application No. GB 1500358.5.
(Continued)

*Primary Examiner* — Ojiako Nwugo
(74) *Attorney, Agent, or Firm* — Haynes and Boone, LLP

(57) ABSTRACT

A computer-implemented method comprises: receiving (100) first information indicative of a tracking device being located in a particular place, for example by detecting that the tracking device is connected to a charging station for charging; receiving (102) second information, from a passive detecting means, indicative of the user of the tracking device leaving said place, for example based on sounds that the user has made in leaving; (104) determining, based on the first and second information, that a user of the tracking device leaves said place while the tracking device remains in said place; further to said determining, causing (106) at least one separation related action to be performed, for example sending a message to a remote server (14).

20 Claims, 6 Drawing Sheets

(51) Int. Cl.
*G08B 25/10* (2006.01)
*G08B 21/04* (2006.01)
*G08B 29/18* (2006.01)

(58) Field of Classification Search
USPC ..... 340/539.13, 539.15
See application file for complete search history.

(56) References Cited

U.S. PATENT DOCUMENTS

2009/0128346 A1* 5/2009 Zhao ..... G08B 21/24 340/636.15
2010/0289644 A1* 11/2010 Slavin ..... G08B 13/2402 340/568.1
2010/0315241 A1* 12/2010 Jow ..... A01K 11/008 340/573.3
2012/0178505 A1* 7/2012 Yang ..... G06F 1/1628 455/573
2013/0033965 A1 2/2013 Gabara
2013/0099923 A1* 4/2013 Zschiedrich ..... G08B 13/2462 340/539.32
2013/0120139 A1* 5/2013 Chen ..... G08B 13/1427 340/539.1
2014/0002239 A1 1/2014 Rayner

FOREIGN PATENT DOCUMENTS

JP 2006171897 A 6/2006
WO WO 2004/100101 A 11/2004
WO WO 2008/088341 A 7/2008

OTHER PUBLICATIONS

Combined Search and Examination Report dated Jun. 30, 2015 from related German Application No. GB 1500358.5.
International Search Report and Written Opinion completed Apr. 12, 2016 and dated Apr. 19, 2016 from International Application No. PCT/GB2016/050040 filed Jan. 8, 2016.

* cited by examiner

DETERMINING ENTRY INTO OR EXIT FROM A PLACE WHILE A TRACKING DEVICE IS IN THE PLACE

CROSS-REFERENCE TO RELATED APPLICATIONS

This application is a U.S. national stage continuation application under 35 U.S.C. § 371 of International Patent Application No. PCT/GB2016/050040 filed on Jan. 8, 2016, which claims the benefit of Great Britain Patent Application No. 1500358.5 filed on Jan. 9, 2015, the contents of each of which are incorporated herein by reference.

FIELD OF THE INVENTION

The present invention relates to a method of and an apparatus for determining that a user of a tracking device leaves a place or another person enters a place, while the tracking device remains in the place.

BACKGROUND TO THE INVENTION

It is often desirable to monitor vulnerable people, such as the elderly or those with Alzheimer's disease by tracking their location. A tracking unit may be attached to or carried by a person to be monitored. A monitoring system may be configured so that an alert is generated if the monitored person leaves a particular place, such as their home or a care home. Also, the tracking unit, and/or subsidiary device, may include components such as an accelerometer, so that, for example, if the monitored person falls, the tracking unit may use such components to detect this and to consequently generate an alert.

In order for the tracking unit to be used to monitor the person, it is of course required that the person carry the tracking unit with them. While it is possible to secure the tracking unit to the person to be tracked, for example around their ankle, it is preferable for the tracking unit to be detachable. The ability to detach facilitates charging of a battery in the tracking unit. Also, securing of the tracking unit to a person to be monitored such that the person cannot remove the tracking unit may not accord with the wishes of that person.

A problem with detachability of the tracking unit is that the monitored person may forget or choose not to bring the tracking unit with them when they leave their home or care home. While the presence of a person within a home may be detected in an attempt to address this problem, the home may have multiple occupants or visitors and the monitored person cannot be differentiated.

It is an object of the present invention to address these problems.

SUMMARY OF THE INVENTION

According to a first aspect of the present invention, there is provided a computer-implemented method comprising: receiving first information indicative of a tracking device being located in a particular place; receiving second information, from a passive detecting means, indicative of a user of the tracking device leaving said place or another person entering said place; determining, based on the first and second information, that the user of the tracking device leaves said place or the other person enters while the tracking device remains in said place; further to said determining, causing at least one action to be performed. This addresses the problems mentioned above.

The receiving of the first information preferably comprises receiving information on whether the tracking device is connected to a charging station. Alternatively, the receiving of the first information may comprise receiving information on whether the tracking device is sufficiently close to a first communications means located in the place to enable short-range communication or a signal of a predetermined strength.

The at least one action may comprise sending third information indicative of a result of said determining to at least one of: a server means, for example under the control of a care provider; a communications device of a predetermined person, for example a carer, other than the user of the tracking device; or a communications device of the user. The server means may be configured, in response to receiving the third information, also to take one or more actions, for example relating to raising an alarm.

The method may be performed at a controller means, or may be performed elsewhere, for example at the tracking device. The tracking device is typically configured for communication with a cellular communications network. Where the determining is performed at the controller means located in the place, it may be convenient for the controller means to send the third information to the tracking device, so that the tracking device can send the third information. Thus hardware for communication with a cellular communications network need not duplicated.

The at least one action may usefully comprise one or both of: causing a speaker to generate a sound audible to the user; causing a light to aluminate that is visible to the user. Thus the user may be alerted to having left the place without the tracking device, or the user and/or the other person may be alerted to an issue relating to the other person being there.

The method may further usefully comprise, when the user comes into the place from outside with the tracking device, indicating to the user that the tracking device should be connected to a charging means, for example by flashing of the tracking device or by a beeping sound generated by the tracking device or by the controller means.

The second information may be indicative of at least one event having occurred, the at least one event being associated with the user leaving or other person entering. The or each event is such that it generates a corresponding acoustic signal detectable by the passive detecting means, and the second information may be based on the or each acoustic signal. The or each acoustic signal may be processed into a respective acoustic signature and the second information determined using the or each acoustic signature.

The receiving of the second information may comprise receiving first signature information indicative of a first stored signature corresponding to an acoustic signal having been collected indicative of a first event. For example, the acoustic signal may have been caused by the sound of a door opening and the first stored signature may correspond to this sound.

The receiving of the second information may further comprise receiving second signature information indicative of a second stored signature corresponding to a sound having been collected indicative of a second event.

The method may further comprise determining, based on the receiving of the first and second signature information, that a sequence of signature information has been received; wherein the determining that a user of the tracking device leaves said place while the tracking device remains in said place is dependent on the determining of the sequence.

The method may further comprise, after the determining that the user of the tracking device leaves or the other person enters said place while the tracking device remains in said place, activating an alert state, and if, after a predetermined period the alert state has not expired, causing the at least one action to be performed. The method may also comprise determining before the predetermined period has expired that the alert state is to be cancelled, and cancelling the alert state. This is useful in preventing false alerts.

The method may further comprise, after the determining that a user of the tracking device leaves or the other person enters said place while the tracking device remains in said place, receiving at least one further signature information indicative of at least one further stored signature corresponding to at least one sound having been collected indicative of a third event; determining that the alert state should be cancelled based on the received at least one further signature information.

The method may further comprise, after determining, based on the receiving of the further signature information, that a further sequence of signature information has been received; wherein the determining that the alert state should be cancelled is based on the determine further sequence.

The method may further comprise: receiving, from a communications device separate to the tracking device, first acceleration information corresponding temporally with the collected sound from which the first signature information derives; determining, dependent on the first acceleration information, whether the first event and the acceleration information are compatible; determining that a user of the tracking device leaves said place while the tracking device remains in said place dependent on if the first event and the first acceleration information are compatible.

In some embodiments, the method may comprise receiving, from a communications device separate to the tracking device, second acceleration information corresponding temporally with the collected sound from which the second signature information derives; determining, dependent on the second acceleration information, whether the second event and the second acceleration information are compatible; determining that a user of the tracking device leaves said place while the tracking device remains in said place dependent on if the second event and the second acceleration information are compatible.

The method may further comprise processing collecting sound using a low-pass filtering system. This preferably results in a signal from which speech cannot be derived.

The method of any one of the preceding claims, further comprising: processing collected sound to generate acoustic signatures; comparing said acoustic signatures with stored signatures to identify matches.

According to a second aspect of the present invention, there is provided an apparatus comprising a controller means configured to: receive first information indicative of a tracking device being located in a particular place; receive, from a passive detector means, second information indicative of a user of the tracking device leaving said place or another person entering said place; determine, based on the first and second information, that a user of the tracking device leaves said place or the other person enters said place, while the tracking device remains in said place; further to said determining, cause at least one action to be performed.

The apparatus may further comprise a charging station, wherein the first information is indicative of the tracking device being located connected to the charging station.

The tracking device may be configured to provide location information indicative of the location of the tracking device to a server using a cellular communications network.

The detecting means may comprise at least one acoustic monitor means for collecting environmental sound, and at least partially generating the second information based on the collected sound, and seconding the at least partially generated second information to the controller means.

The at least one acoustic monitor means may be configured to convert said collected sound into electrical signals, and may comprise a low-pass filtering means to reduce the bandwidth of the sound.

The at least one acoustic monitor means may be configured to generate acoustic signatures based on collected sound, wherein the second information is dependent on the acoustic signatures.

The at least one acoustic monitor means may be configured to compare generated acoustic signatures with stored signatures, wherein the second information is indicative of stored signatures against which acoustic signatures have been matched.

The at least one acoustic monitor may be configured to communication with the controller means over mains electricity cables.

The at least one acoustic monitor and the controller means may each have radio frequency transceivers to enable communication between them.

The tracking device may include an accelerometer, wherein received second information can be validated by comparison against acceleration information received from the accelerometer.

The apparatus may further comprise a personal, portable communications device separate to the tracking device and carried by the user. In this case, the communications device may include an accelerometer means and be configured to provide acceleration information to the controller means. The controller means is in this case further configured to compare the acceleration information received from the accelerometer means with received second information so as to validate the received second information.

The communications device may be further configured to generate location data indicative of the location of the communications device and to send the location data to the tracking device or to a remote server.

The apparatus may be further configured to carry out any aspects of the method of the first aspect of the invention.

There may also be provided a computer program comprising computer program code stored on a computer readable storage medium, which, when executed by a processing means, is configured to perform the method of the first aspect of the present invention.

BRIEF DESCRIPTION OF THE DRAWINGS

Embodiments of the present invention will now be described, by way of example only, with reference to the accompanying Figures, in which.

DETAILED DESCRIPTION OF EMBODIMENTS

Figure 1:
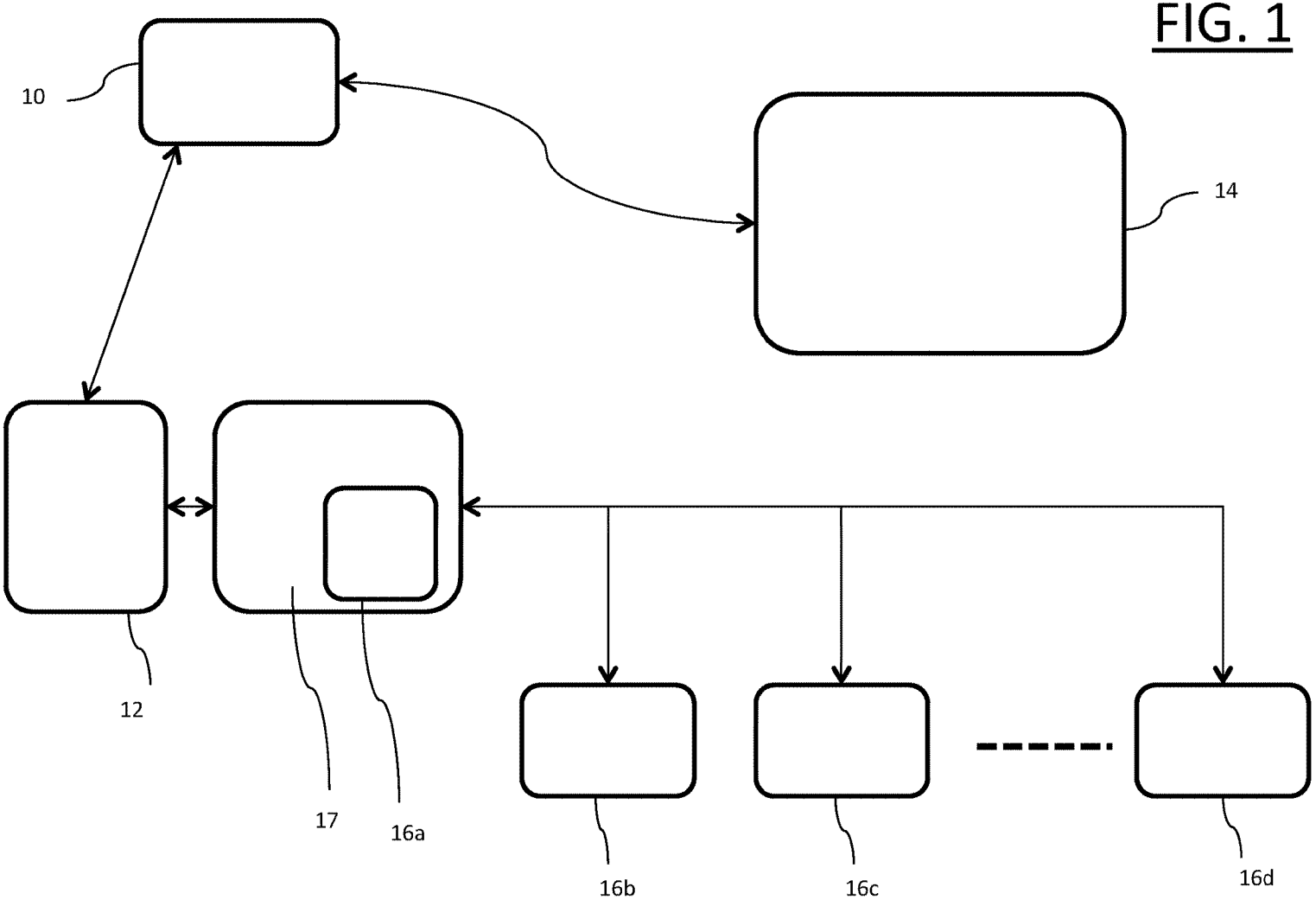
FIG. 1 is an overview diagram of elements of a system in accordance with an embodiment of the invention.

Referring to FIG. 1, a monitoring system comprises a tracker unit 10, a charging station 12, a remote server 14, passive detecting means in the form of several acoustic monitors 16*a-d* and an controller unit 17. The monitoring system is located in the home of a person who is being monitored, although embodiments of the invention are not limited to use in a home and may be used in other suitable places or environments such as a care home, as well as outside a home but in the vicinity of the home. For ease of understanding we use the term "home" to include all locations where the tracker unit may be paired with and place on a charging station.

Figure 2:
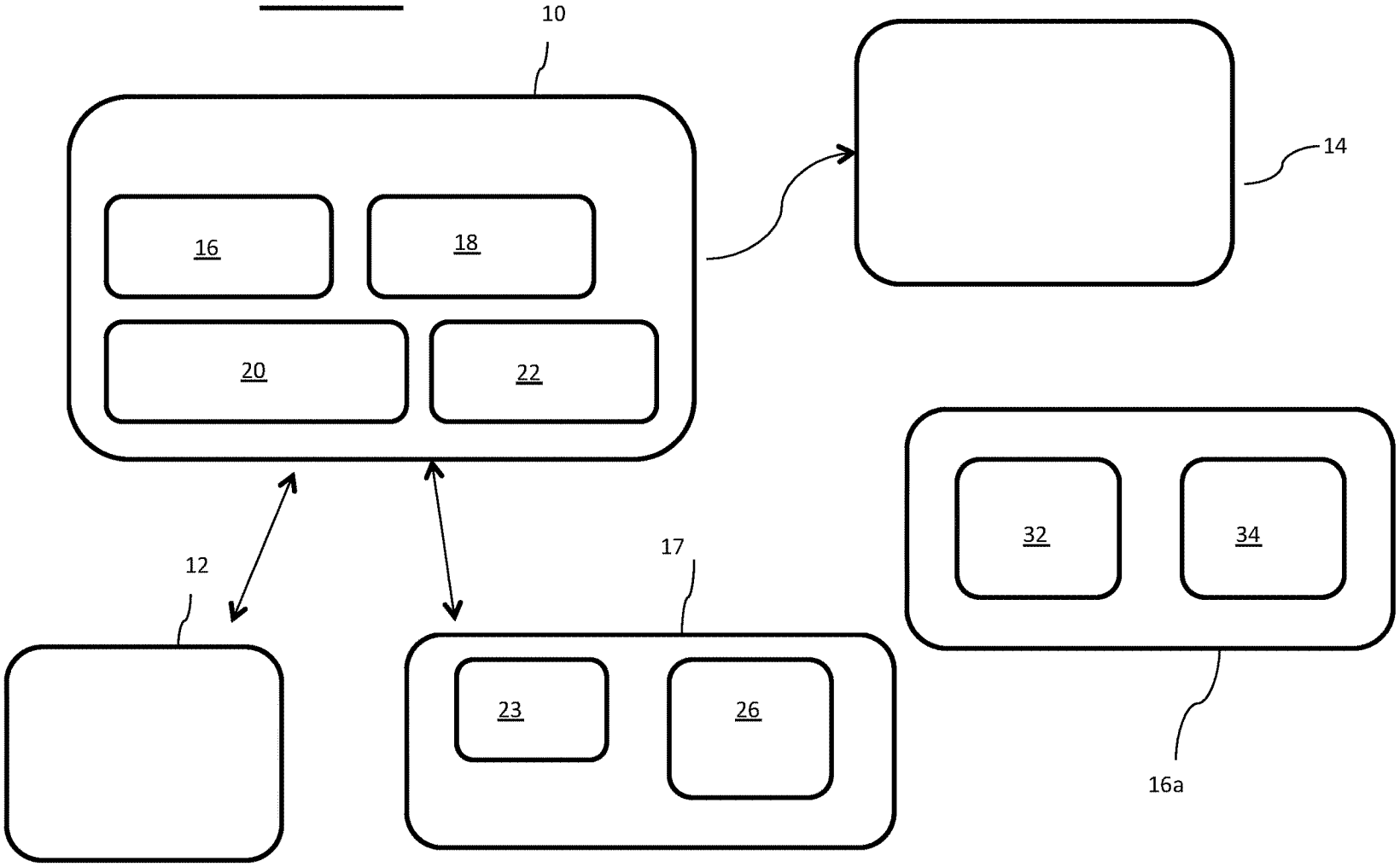
FIG. 2 indicates diagrammatically parts of some of the elements.

The tracker unit 10 is attachable to an ankle of the tracked person. Alternatively, the tracking device may be attachable to another part of the monitored person's body, for example to a wrist or waist, or may simply be designed for carrying by the monitored person and not for attachment to a body part. Referring also to FIG. 2, the tracker unit 10 includes a GPS (Global Positioning System) locator 15, a first communications unit 18, an accelerometer 20, a microcontroller 19, a second communications unit 22, all operatively coupled. The tracking unit 10 also includes an interface for docking on or otherwise connecting to the charging station 12 for charging. Other components may also be provided in the tracker unit 10.

The microcontroller 19 includes at least one processor (not shown) and at least one memory (not shown). The at least one memory has computer program code stored on it, which, when executed by the at least one processor, causes the tracking device 10 to function as described herein.

The GPS locator 15 is configured to receive GPS signals and to provide location information indicative of the location of the tracker unit 10 to the first communications unit 18. In alternative embodiments, the locator may use an alternative global navigation satellite system (GNSS) technology in place of or in addition to GPS.

The first communications unit 18 enables communication with base stations of a cellular communications network. Thus, the location information generated by the GPS locator 16 can be sent to the remote server 14. The first communications unit 18 comprises components required for such communication, including a transmitter and a receiver. The cellular telecommunications network may operate in accordance with 3GPP (Third Generation Partnership Project) standards, for example in accordance with GSM, GPRS and EDGE standards, or 3GPP2 standards, for example CDMA2000.

In an alternative embodiment, the first communications unit 18 may send data, such as the location data, to the remote server 14 via one or more other networks. For example, the first communications unit 18 may enable communication with a local area network or a metropolitan area network, which are internet-connected, and such data can be sent via such networks. In this case, the first communications unit 18 need not be configured for communication with base stations.

In alternative embodiments, the GPS locator 16 or other GNSS locator may be absent. Instead, the location of the tracker unit 10 may be determined using another real-time location detection technology; for example, where a signal from the first communications unit 18 is received by more than one base station, information on the location of the tracking unit 10 can be derived based on relative strength of the received signal at each base station. Such other technology may be used in combination with a GNSS locator for improved accuracy.

The second communications unit 22 is configured for short-range radio frequency (RF) communication with the controller unit 17, when the tracking unit 10 is within range of the controller unit 17. An RF link between the second communications unit 22 and the controller unit 17 can be provided using any suitable short-range wireless communications technology. For example, the RF link may operate using Bluetooth.

The accelerometer 20 is configured to measure acceleration of the tracker unit 10 and thus provide acceleration information. The acceleration information can be sent from the tracking unit 10 to the controller unit 17 using the RF link. The acceleration information is sent to the controller unit 17 in real-time or close to real-time. In other embodiments of the invention, the accelerometer 20 may be absent. It is not essential to the invention.

The charging station 12 is configured for charging of the tracking unit 10 when the tracking unit 10 is connected to the charging station 12. The charging station 12 includes a charging circuit 24 connected to a mains power supply (not shown), to enable charging when the tracking unit 10 is connected. The tracking unit 10 and the charging station 12 may be respectively configured so that the tracking unit 10 can be docked at the charging station 12. Alternatively, the tracking unit 10 may be connectable to the charging station using a cable for charging.

The tracking unit 10 can send location information to the remote server 14 using the first communications unit 18. As with prior art monitoring systems, the remote server 14 is configured to receive location information from the tracking unit 10 and to generate an alert notification or perform another action if certain events occur; for example, the remote server 14 may be configured to generate and send an alert notification to a communications device of a designated person, such as a carer, if the monitored person, when carrying the device, leaves his or her home, or leaves his or her home between certain predefined times.

The controller unit 17 includes a controller providing an executive control function. The controller 23 includes at least one processor (not shown) and at least one memory (not shown), the at least one memory having computer program instructions stored on it which, when executed by the processor, result in the control functions herein ascribed to the controller unit 17, being performed.

The controller unit 17 also includes a third communications unit 26 configured for short-range wireless communication with the second communication unit 22 of the tracking unit 10 to enable the RF link.

In order to send messages to the remote server 14, the controller unit 17 is configured to send the messages wirelessly to the tracking unit 10, which then sends them to the remote server 14 using the first communications unit 18.

The controller unit 17 is configured to determine whether the monitored person has left the home, in a manner that will be described in detail below. The controller unit 17 is also configured to detect when the tracking unit 10 is within the home, so that the controller unit 17 can also determine whether the monitored person has left home without the tracking unit 10. The controller unit 17 is connected to the charging station 12, and the charging station 12 is configured to periodically provide to the controller 23 a signal indicating whether the tracking unit 10 is connected to the charging station 12. Accordingly, presence of the tracking device 10 is detected.

Alternatively, the charging station 12 may provide a continuous signal to indicate that the tracking unit 10 is connected to the charging station 12 to the controller 23, or the charging station 12 may provide such an indication in response to a request from the controller 23. The controller unit 17 may be housed with the charging station 12. The controller unit 17 and the charging station 12 may be made as a single product, for example with components being formed on the same circuit board. Other ways of indicating to the controller unit 17 that the tracking unit 10 is connected to the charging station 12 are possible.

Although not essential to the invention, the tracking unit 10 is usefully configured to encourage the monitored person to connect the tracking unit 10 to the charging station 12 when the tracking unit 10 is brought into the vicinity of the charging station 12, but is not docked or otherwise connected, for example when the tracking unit 10 is brought home from outside. This may be done, assuming that the charging station 12 and the controller unit 17 are located close together, based on the tracking unit 10 being brought close enough to the controller unit 17 for the RF link to be established, or based on the RF link being of at least a threshold strength. In other embodiments, this may also be done using the location data detected by the locator 16. In this latter case, the remote server 14 is configured to determine that the tracking unit 10 has moved into the vicinity of the charging station 12 and to send a notification message to the tracking unit 10.

In response to detecting that the charging station 12 is close, the controller unit 10 is also configured to indicate to the monitored person that the tracking unit 10 should be connected to the charging station 12. Preferably, this is done in a manner such that the monitored person cannot avoid being made aware that the tracking unit 10 should be connected to the charging unit 12. For example, the tracking unit 10 may have a lighting system and be configured to cause the lighting system to flash, and/or an audio system and be configured to cause the audio system to sound. Thus, with such functionality it can be expected that, when the monitored person is home, the tracking unit 10 is connected to the charging station 12. The tracking unit 10 may also have functionality to enable the monitored person to turn off such flashing or audio if they do not wish to connect the tracking unit 10 to the charging station 12. For example, it may be preferred to keep the tracking unit 10 on their person.

Instead of the tracking unit 10 being configured to indicate to the monitored person that the tracking unit 10 should be connected to the charging station 12, the controller unit 10 can be configured to indicate such. In this case, either the controller unit 17 is configured to detect that the tracking unit 10 has come within range, or the tracking unit 10 does this and sends a notification message to the controller unit 17. In response to detecting that the tracking unit 10 is close or to receiving such a notification, the controller unit 17 may, for example, use a lighting system and/or audio system to draw to the monitored person's attention that the tracker unit 10 should be connected to the charging station 12.

If the controller unit 17 determines that the monitored person has left the home without the tracking unit 10, the acoustic monitoring is configured to cause one or more unknown location related actions to be performed.

The acoustic monitors 16*a-d* are configured to collect sound from the environment and to produce an electrical signal indicative of the collected sound or at least certain information about the sound. Herein, the word "sound" includes infra-sound and ultra-sound, that is, sound that may not be audible to the human ear, but may be usefully used to detect occurrence of events from which an acoustic signature can be produced. The acoustic monitors 16*a-d* are also each configured to process the electrical signals and send the processed electrical signals to the controller unit 17. The acoustic monitors 16*a-d* each comprise an acoustic pick-up device in the form of a microphone 31, a low-pass filtering system 32 and a signal compression and identification circuit 34, all operatively coupled. A first 16*a* of the acoustic monitors is located within the controller unit 17. The other acoustic monitors 16*b-d* are located elsewhere in the home, for example by doors, in light fixtures, at mains plug sockets, etc.

The acoustic monitors 16*a-d* are connected to the controller unit 17 using cables, but embodiments of the invention are also not limited to any particular way by which the acoustic monitors send collected information on environmental sound to the controller unit 17. In a variant embodiment, the controller unit 17 may comprise an RF communications unit and each acoustic monitor 16*a-d* may also include an RF communications unit (not shown) configured to wirelessly provide information on collected environmental sound to the controller unit 17. In another variant embodiment, the controller unit 17 and the acoustic monitors 16*b-d* may be connected to the home electricity network for data over mains communication. In this case, the information on collected environmental sound may be sent from acoustic monitor 16*b-d* to the controller unit 17 by data over mains transmission. In a yet other variant embodiment, the acoustic monitors 16*b-d* may communicate with the controller unit 17 using optical free-space links or optical fibres, the electrical signal being converted at the or each acoustic monitor to an optical signal, and converted to an electrical signal at the controller unit 17.

Embodiments of the invention are not limited to use of the controller unit 17 with any particular number of acoustic monitors. There may be only a single acoustic monitor. The acoustic monitors 16*a-d* may each be powered by battery, by mains connection, by attached solar panel or by other means.

In alternative embodiments, the low-pass filtering system 32 and the signal compression and identification circuit 34 may be located in the controller unit 17. The low-pass filtering system 32 may be located in the acoustic monitor and the signal compression and identification circuit 34 may be located in the controller 17.

The low-pass filtering system 32 is configured to receive electrical signals from the acoustic monitors 30 and to process the signals to reduce the bandwidth of the signals. The electrical signals of reduced bandwidth are then provided to the signal compression and identification circuit 34. This circuit 34 is configured to receive the electrical signals from the low-pass filter 32 and to process the signals each into an acoustic signature comprising component parts thereof. The processing of the signal by the low-pass filter reduces load on the signal compression and identification circuit 34. Also, reducing the bandwidth means that the full spectrum of the original sound cannot be reproduced from the process signal, thereby preserving the privacy of the monitored person.

The circuit 34 has a database stored in a memory thereof comprising stored signatures. The circuit 34 is further configured to compare acoustic signatures with stored signatures in the database. Each stored signature corresponds to a sound generated by a particular action. By way of example, a stored signature may correspond to The monitored person walking;

The outside door opening;

The outside door closing;

A light switch being pressed.

The controller unit 17 is configured to receive signals indicative of identified stored signatures corresponding to acoustic signatures from the acoustic monitors 16*a-d*. As will be appreciated, many acoustic signatures that are generated by the circuit 34 will not correspond to stored signatures.

The circuit 34 also has a database on the at least one memory thereof having pattern information on the stored signatures. The pattern information identifies sequences of stored signatures. If acoustic signatures are received which correspond to any one of a first set of the stored signatures, the controller unit 17 is configured to determine that the monitored person has left or is leaving the home.

If this occurs, the controller unit 17 is configured to activate an alert state.

If any one of a second set of the sequences is matched within a predetermined period of one of the first set of sequences being matched, the controller unit is configured to cancel the alert state.

In some embodiments, the predetermined period in which a sequence of stored signatures in the second set is identified may be specific to the particular sequence of the first set due to which the alert state has been activated.

In the event of the alert state being activated and the alert state not being cancelled within the predetermined time period, the controller unit 17 is configured to perform at least one separation related action, that is, at least one action relating to the monitoring person and the tracking unit 10 being separated such that the location of the monitored person is unknown. The at least one separation related action may comprise any one or more of the following actions:

1) The controller unit 17 sends to the remote server 14 a message indicating that the monitored person has left the home without the tracking unit 10. How the remote server 14 responds to such a message is described below.

2) The controller unit 17 causes the tracking unit 10 to send a message to a personal, portable communications device (not illustrated) typically carried by the monitored person indicating that the person has left without the tracking unit 10 using the first communications unit 18. Such a device may be in the form of a mobile phone. The message may be, for example, in the form of a text message, a pre-recorded voice message or email. In response to the message, the monitored person, may return to the home to retrieve the tracking unit or may contact a predetermined person, such as a care worker or a responsible family member, to communicate their whereabouts.

3) The controller unit 17 causes an audio alarm to sound. The controller unit 17 may be coupled, wirelessly or otherwise, to a speaker or a plurality of speakers. The speaker or plurality thereof can be housed in the charging station 12, the tracker unit 17 or be located remotely, for example near an outer door to the home to this end. The audio alarm sounds within a time period, such that the monitored person would typically be within hearing range to hear the alarm.

4) The controller unit 17 causes a lighting system to illuminate. The controller unit 17 may be coupled, wirelessly or otherwise, to a lighting system or plurality of lighting systems. The lighting system or plurality thereof can be housed in the charging station 12, the tracker unit 17 or remotely, for example near the outer door of the property. The controller unit 17 is configured to cause the lighting system to illuminate within a predetermined period, such that the lighting system attracts the attention of the monitored person.

Different embodiments of the invention may include the functionality for any one, more than one or all of separation related actions 1) to 4) to occur.

In order to send messages mentioned at 1) and/or 2) to the remote server 14 or the personal communications device, the controller unit 17 sends the messages wirelessly to the tracking unit 10 over the RF link, which may then send them using the first communications unit 18.

In alternative embodiments, messages may be otherwise sent to the remote server 14 or the personal communications device. In one alternative embodiment, the controller unit 17 and the tracking unit 10 are configured so that, when the tracking unit 10 is docked or otherwise connected to the charging station 12, the controller unit 17 can provide messages to the tracking unit 10 using a physical connection. The tracking unit 10 is configured, further to receipt of such messages, to send the message to the remote server 14. The connection of the controller unit 17 and the tracking unit 10 may be via the charging station 12. In this embodiment, wireless communication between the tracking unit 10 and the controller unit 17 is not required in order for messages to be sent to the remote server 14.

In another alternative embodiment, the controller unit 17 is connected to the internet, for example via a local area network. In this case, the controller unit 17 is configured to send messages to the remote server 14 or the personal communications device via the internet. In another variant embodiment, the controller unit is connected to a PSTN network. In this case, the controller unit may send messages to the remote sever 14 over the PSTN network. In another variant alternative embodiment, the controller unit 17 has a further communications unit configured to enable communication with a cellular communications network, and messages can be sent via one or more base stations thereof. Embodiments of the invention are not limited to any particular way in which the controller unit 17 sends messages to the remote server 14 or the personal communications device.

In response to receiving a message indicating that the monitored person has left the home without the tracking unit 10, the remote server 14 is configured to perform at least one action. The at least one action may be one or more of the following actions a) to c). However, embodiments of the invention are not limited to such actions.

a) The remote server 14 sends a message to the portable, personal communications device typically carried by the monitored person indicating that the tracking unit 10 has been left. The message may be, for example, in the form of a text message or a pre-recorded voice message. The monitored person, on receipt of such a message, may return to the home to retrieve the tracking unit 10. Additionally or alternatively, the monitored person may contact a predetermined person, such as a care worker or a responsible family member of the monitored person, to communicate their whereabouts.

b) The remote server 14 sends a message to a personal, portable communications device, such as a mobile phone, of a predetermined person, such as a care worker or a responsible family member of the monitored person. The message may be, for example in the form of a text message or pre-recorded voicemail message. The predetermined person may be charged with following up as to the whereabouts of the monitored person.

c) The remote server 14 may create and store a record of the time at which the monitored person has left their home without the tracking unit 10. Appropriate action relating to the monitored person can then later be taken.

Figure 3:
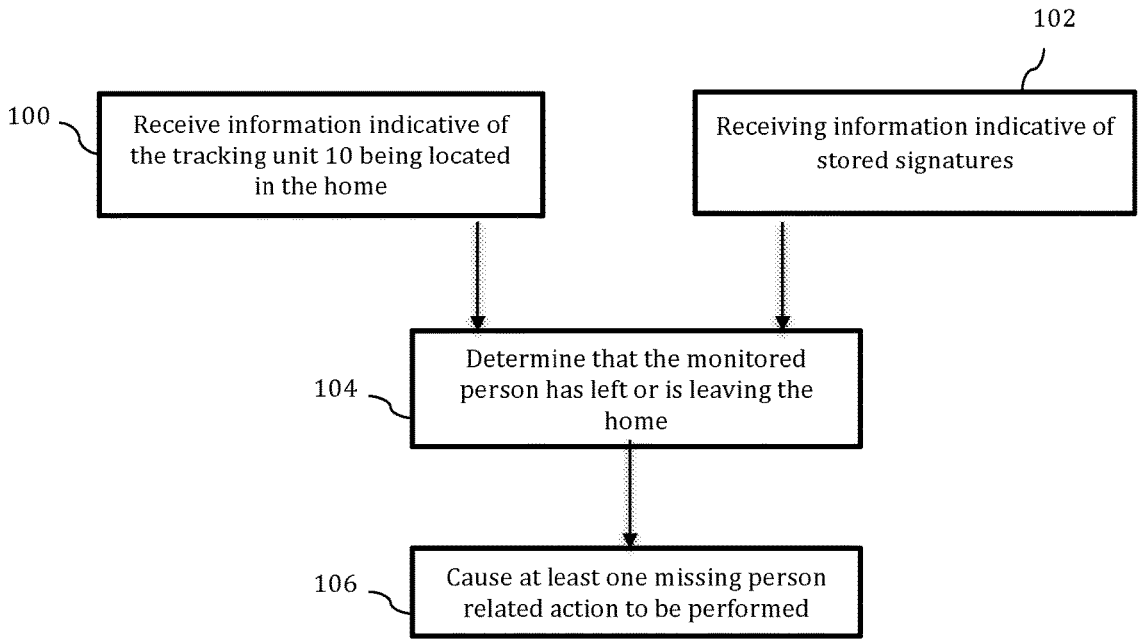
FIG. 3 indicates diagrammatically the elements and parts thereof shown in FIG. 2, together with another, separate element that can be carried by the monitored person.
Figure 4:
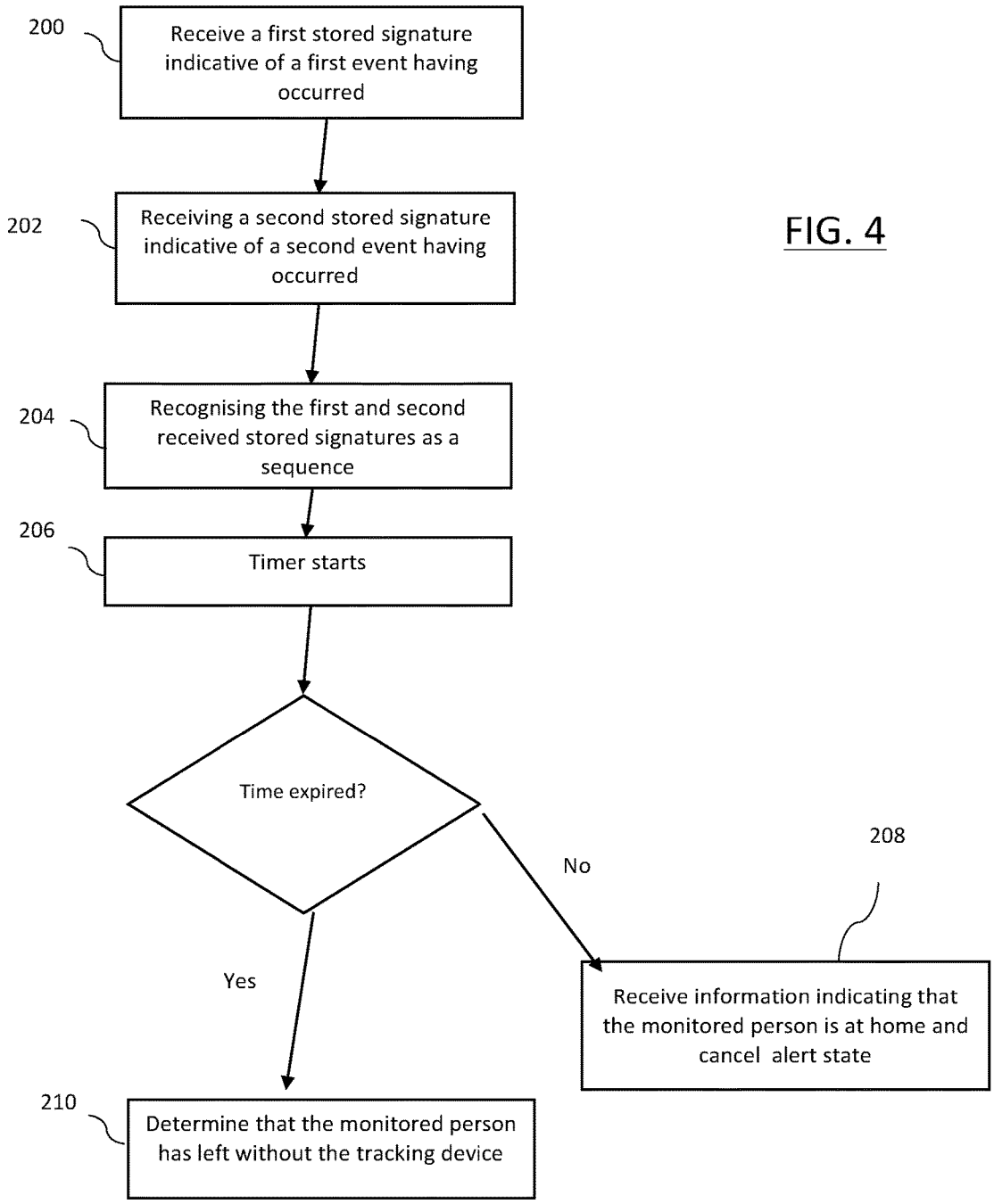
FIG. 4 is a flowchart indicating main steps in operation of the system.

Operation of the system will now be described with reference to FIGS. 3, 4 and 5. As indicated in FIG. 4, which provides an overview of how the system operates, at step 100, the controller unit 17 receives information indicative of the tracking unit 10 being located in the home, in the form of signals from the charging station 12 indicating that the tracking device 10 is connected. At step 102, the acoustic monitoring station 17 receives electrical signals from at least one of the acoustic monitors 16*a-d* providing information on ambient sound. At step 104, the acoustic monitoring station determines that the received electric signals indicate that the monitored person has left the home without the tracking unit 10. Consequently, the controller unit 17 causes at least one of the separation actions to be performed at step 106.

Step 102 and 104 are now described in greater detail with reference to FIGS. 4 and 5, also using an example involving detecting a monitored person leave the home without the tracking unit 10. With regard to step 102, the controller unit 17 receives at step 200 from one of the acoustic monitors 16*a-d* first information indicating that a first stored signature indicative of a first event has been identified by one of the acoustic monitors 16*a-d*. In the example, the monitored person goes to an outside door and the sound of the person walking to the outside door may result in the first stored signature being identified.

The controller unit 17 then receives at step 202 from one of the acoustic monitors 16*a-d* second information indicating that a second stored signature indicative of a second event has been identified by one of the acoustic monitors 16*a-d*. In the example, the monitored person opens the outside door and the sound of this results in the second stored signature being identified.

The controller unit 17 then recognizes at step 204 the first and second stored signatures that have been identified as being a sequence of signatures in the first set of sequences. Since one of the sequences in the first set has been identified, the controller unit 17 determines at step 206, based on the recognised sequence corresponding to stored sequence information, to activate the alert state in which a timer is started and does so.

If a predetermined period expires without cancellation of the alert state, the controller unit 17 determines at step 106 to perform at least one of the separation related actions. In this example of the operation, the controller unit 17 sends a message to the remote server 14 indicating that the monitored person has left the home. The remote server 14 then sends a message notifying such to a designated person. On receipt of the notification message, the designated person can then take appropriate action, for example look for the monitored person.

Alternatively, if the controller unit 17 determines that the alert state is to be cancelled before the timer expires, the timer is stopped, as indicated at step 208.

Figure 5:
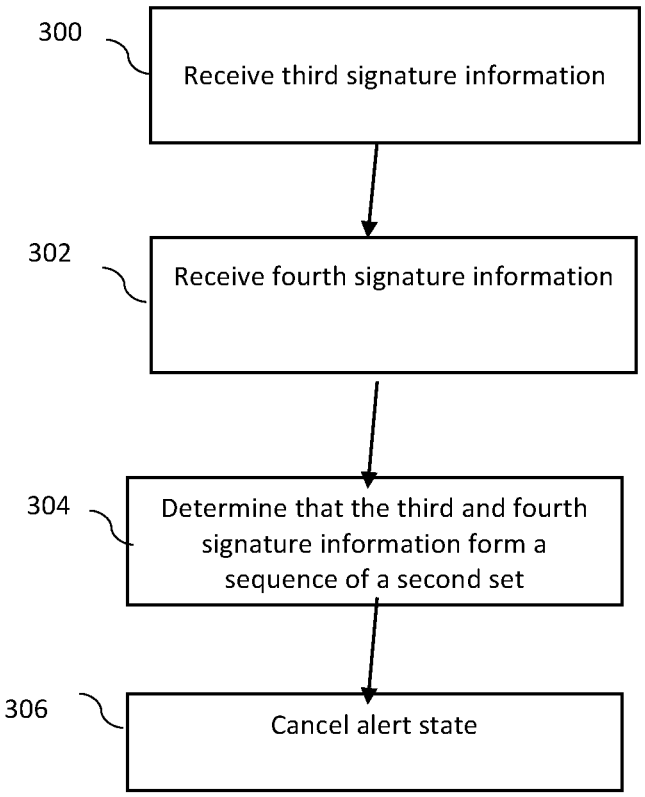
FIGS. 5A and 5B are a flowchart indicating steps involved in operation of the system.

Referring to FIG. 5, the controller unit 17 may determine to cancel the alert state based on environmental sound. The controller unit 17 receives at step 300 from one of the acoustic monitors 16*a-d* third information indicating that a third stored signature indicative of a third event has been identified. In the example, the acoustic signature is indicative of the sound the outside door closing.

The controller unit 17 then receives at step 302 from one of the acoustic monitors 16*a-d* a fourth electrical signal providing a fourth acoustic signature indicative of a fourth event. In the example, the fourth event is the monitored person walking.

The controller unit 17 then determines at step 304 that the third and fourth acoustic signatures form one of the sequences of the second set. Since a one of the second sequences has been identified before the timer has expired, the controller unit 17 cancels the alert state at step 306.

In a variant embodiment, the controller unit 17 performs the separation related action after a sequence in the first set has been detected and without waiting for the timer to expire. In this case, if a sequence in the second set is then identified before the timer has expired, the controller unit 17 can follow up with a cancellation action, for example, by turning off any audio alarm or lighting system, or by sending a cancellation message to the remote server 14.

Generally, it is desired for the controller unit 17 not to erroneously perform missing the separation related action—this is why the controller unit 17 is configured to detect a sequence of stored signatures from the second set, which indicate that the monitored person has not in fact left and thus that the alert state should be cancelled.

However, in some embodiments the controller unit 17 may not be configured to cancel the alert state. Thus, the steps relating to cancellation of the alert state may be absent. In this case, after a sequence of stored signatures in the first set has been matched to, at least one separation related action is performed. An alert state need not be activated—the controller unit 17 simply performs one or more of the separation related actions.

It is described above that the controller unit 17 detects that the tracking unit 10 is separated from the monitored person when the monitored person has left by detecting that the tracking unit 10 is connected to the charging station 12. This is generally useful, since it can reasonably be expected that if the monitored person is at home, the tracking unit 10 is being charged, especially if the tracking unit 10 or the controller unit 17 is configured to encourage the monitored person to connect the tracking unit 10 to the charging station 12. However, embodiments of the invention are not limited to any particular way in which location of the tracking unit 10 within the home is detected.

In a variant embodiment, the controller unit 17 is configured to detect that the tracking unit 10 is located within a predetermined area by maintenance of communication with it. For example, the controller unit 17 may be configured to broadcast periodically, for example every 30 seconds, an echo request, to which the tracking unit 10 responds when within range of the controller unit 17. The controller unit 17 may be configured to determine that the tracking unit 10 is located within the home of the monitored person based on maintenance of communication or on signal strength being at least a threshold strength.

In a variant embodiment, the location information indicating location of the tracking unit 10, which the tracking unit 10 sends to the remote server 14, may be sent to the controller unit 17, for example by means of an internet connection. In this case, the controller unit 17 may be preconfigured with its own location information. The controller unit 17 may be configured to detect if the tracking unit 10 is nearby, for example within 30 m. If the tracking unit 10 is considered nearby and the controller unit 17 determines that the monitored person has left the home, it can be determined that the monitored person has left without taking the tracking unit 10 and thus one or more of the separation related actions can be performed.

In another embodiment, the controller unit 17 does not determine whether the tracking unit 10 is located in the home. Instead, the controller unit 17 detects, as described above, whether the monitored person has exited the home and, when this is detected, the controller unit 17 is configured to send to the remote server 14 information indicative of such. The controller unit 17 may also send an indication of whether the tracking unit 10 is connected to the charging station 12 or whether there exists an RF link between the tracking unit 10 and the controller unit 17 indicating that the two are close. The sending of such information may be via the internet, via the PSTN network, or using a suitable communications unit, for example for communication via a cellular communications network. Sending of information by the controller unit 17 using such networks has been described above. The determining of whether the monitored person has left the home without the tracking unit 10 may then be performed at the remote server 14 instead of the controller unit 17. Other functionality of the controller unit 17 may also be transferred to the remote server 14 or other server, for example all or part of the processing and comparison of the electrical signals generated in the acoustic monitors 16*a-d*.

In a variant embodiment, the remote server 14 is conveniently configured, in response to receiving information indicating that the monitored person has left the home, to determine the current location of the tracking unit 10 using the location information received from the tracking unit 10. If the tracking unit 10 remains within the home, the remote server 14 determines that the monitored person has forgotten or otherwise left the tracking unit 10 and thus generates and sends a message, for example one of the messages indicated at 1) and 2) above.

It is desirable to prevent erroneous separation related messages being generated. There are numerous ways in which likelihood of erroneous messages being generated can be reduced.

In embodiments in which location of the tracking unit 10 near to the controller unit 10 is monitored other than by connection with the charging station 12, the accelerator 20 in the tracking unit may usefully be utilized where the monitored person is carrying the tracking unit 10 to prevent errors. The tracking unit 10 may be configured to send acceleration information generated by the accelerometer 20 to the controller unit 17 over the RF link. If the controller unit 17 has activated an alert state, in an optional step, the controller unit 17 may analyse the acceleration information for conflict and, if conflict is determined, cancel the alert state. For example, if the first and second stored signatures that are identified indicate that that a monitored person has walked and has opened the door, but the acceleration information at the times the acoustic information to which these stored signatures correspond were received indicates movement away from the door, the alert state may be cancelled.

Further, in a variant embodiment, the controller unit 17 is configured to generate a walking signature particular to the monitored person based on acoustic information. The controller unit 17 has a generic acoustic walking signature stored. Based on acceleration information, the controller unit 17 is configured to detect when the monitored person is walking and generate the particular walking signature based on sounds received contemporaneously. The sound of the monitored person walking can then be distinguished from the sound of other persons in the home walking.

The voice of the monitored person may also be identified. If the alert state has been activated and the voice of the monitored person is detected, the controller unit 17 may be configured to cancel the alert state.

The controller unit 17 may be configured to generate a score indicative of the likelihood of an acoustic signature corresponding to a stored signature. The controller unit 17 may be configured to determine whether the monitored person has left the home dependent on the score. The score may be sent to the remote server 14, which may assist with assessing the priority with which the monitored person should be contacted.

Figure 6:
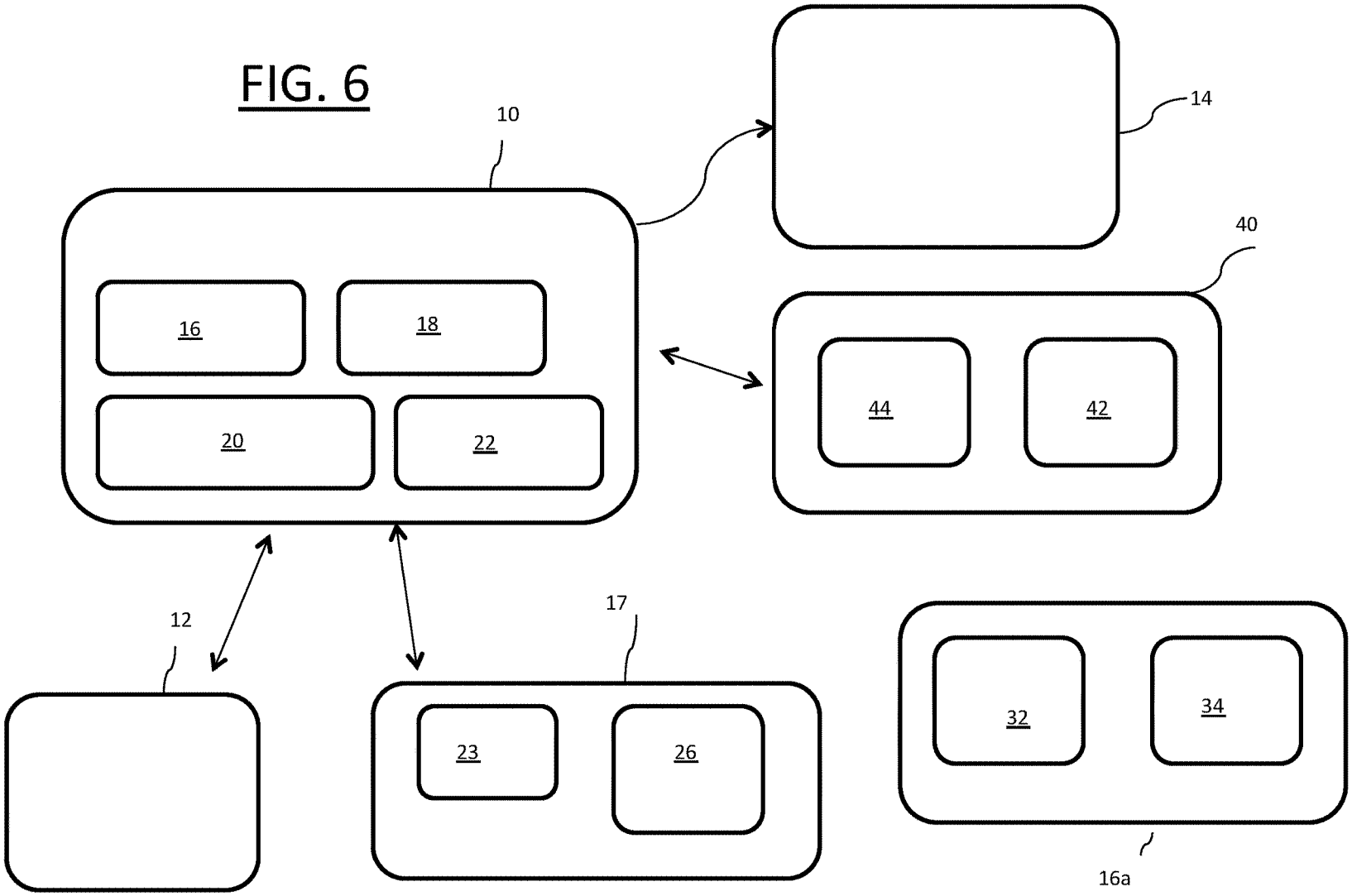
FIG. 6 indicates diagrammatically a system in accordance with a variant embodiment of the invention.

Referring to FIG. 6, in a variant embodiment, the monitored person carries a secondary communications device 40 that is separate to the tracking unit 10 and includes an accelerometer 42, a fourth communications unit 44 and a controller 46, all operatively connected. The fourth communications unit 44 is configured for short-range communication with second communications unit 22 of the tracking unit 10. The communications device 40 may be the personal, portable communications device mentioned above, such as a mobile telephone, or another device or a part thereof, for example a wristband. The other device may be a piece of clothing or jewellery. This separate other device enables a reduced level of monitoring when the tracking unit 10 is detached from the monitored person and is on the charging station 12.

In variant embodiments, the fourth communications unit 44 may, instead of being configured for communication with the second communications unit 22 of the tracking unit 10, be configured for short-range wireless communication with the controller 17. In this case, the third communications 26 is configured for such communication.

The controller 46 comprises at least one processor and at least one memory. The at least one memory has computer program code stored thereon, which, when executed by the at least one processor, result in the controller 46 performing the functions ascribed to it herein.

The accelerometer 42 generates acceleration data, which the fourth communications unit 44 sends to the controller unit 17. The controller unit 17 may use the acceleration data to verify acoustic signatures. To achieve this, one, some or all of the acoustic signatures has acceleration data associated therewith, for example a vector range and/or a magnitude range. In an optional step, the controller unit 17 determines whether acceleration data corresponding in time to particular received acoustic signatures, meets predefined vector and/or magnitude criteria. For example, if the acoustic signature corresponds to movement of the monitored person towards an outer door of the home, it should be expected that the acceleration information at the time of the collected sound comprise an acceleration vector indicating movement towards the outer door. If the acceleration information indicates movement corresponding to the acoustic signature, the acoustic signature is verified. If the acceleration information indicates movement inappropriate for the acoustic signature, for example indicating movement in another part of the home, the acoustic signature is deemed invalid. This usefully enables movement of the user to be distinguished from the movement of other persons. For example, audio signals deriving from sound generated by another person walking in the environment of the monitored person's home can be distinguished from audio signals deriving from sound generated by the monitored person's walking since the controller unit 17 receives acceleration data corresponding to and verifying the sound generated by the monitored person's walking.

The steps described above are carried out at the controller unit 17. In alternative embodiments, steps may instead be carried out in the tracking unit 10, where the tracking unit 10 includes a controller unit configured to carry out such steps. In other alternative embodiments, steps may instead be carried out remotely, for example at the remote server 14. For example, information on whether the tracking unit 10 is connected to the charging station 12 may be sent by the controller unit 17 to the remote server 14, together with data indicative of the In the above, detection of a monitored person leaving a home or other place is described based on detection of environmental sound. However, in alternative embodiments, departure of the monitored person may be otherwise detected using passive detecting means other than acoustic monitors. For example, passive detecting means in the form of sensors may be provided to detect opening of an outside door and/or turning off of lights. Location of a device such as a mobile telephone that is separate to the tracking unit 10 may be tracked, and it may be detected that the monitored person has left the home based on location data from this. Many modern telephones permit location tracking.

The above description relates to use of the system by a vulnerable person. The system also has application in offender management. Tagging of people using tracking units like tracking unit 10 is a tool for courts and penal institutions, for example, to manage persons within their facilities and externally. Electronic tagging may be used with offenders in pre-trial and post-release management of the person monitored. Release may be subject to certain conditions, for example the offender may not be allowed to leave a particular area between certain times. Use of tagging instead of imprisonment reduces prison population and provides a convenient way of verifying that the offender obeys conditions of release.

Typically, a tracking device is secured to an offender, such that it cannot be removed, for example on their ankles. However, some offenders may be permitted to remove their tags when in particular locations, such as their homes, for example for charging. In this case, in order to charge the battery of the tracking device, the offender must connect the tracking device to a power source such that his movement is highly restricted, or a person must visit the offender to change the battery or tracking device periodically. However, sometimes the tracking device may be detachable, in cases where the offender is deemed sufficiently trustworthy to allow this. In such cases, the offender may be permitted to remove the tracking device to charge the battery, avoiding the inconvenience of charging while the tracking device is attached. In either case, embodiments of the invention address a problem that arises if the offender leaves the tracking device and departs from his or her home, or elsewhere, without the tracking device. This might be done intentionally or simply be due to forgetfulness. In either case, the one or more separation related actions that may be carried out may include notifying a third party that the monitored person's whereabouts is unknown; for example a law enforcement authority may be notified.

In another embodiment, the system is configured to detect not when the monitored person exits, but when another person enters. For example, where a monitored person has a tracking unit 10 securely attached thereto, it may be assumed that the tracking unit 10 cannot be removed. In this case, if it is detected that the tracking unit 10 is at the home, it can be assumed that the monitored person is at the home. When a person enters the home, the controller unit 17 receives acoustic information indicative of one or more events associated with a person entering the home, for example, the sound of a doorbell or knocking and/or the sound of the door opening and/or closing and/or the sound of voices. The separation-related action mentioned above may then be replaced with alert actions that are functionally the same as the separation-related actions mentioned above.

In particular, where the monitored person is a sex offender the controller unit 17 may be configured to determine that a new voice belongs to a female or a child. The controller unit 17 may be configured to determine that an alert-related action should be performed based on if the new voice is one of these.

The applicant hereby discloses in isolation each individual feature or step described herein and any combination of two or more such features, to the extent that such features or steps or combinations of features and/or steps are capable of being carried out based on the present specification as a whole in the light of the common general knowledge of a person skilled in the art, irrespective of whether such features or steps or combinations of features and/or steps solve any problems disclosed herein, and without limitation to the scope of the claims. The applicant indicates that aspects of the present invention may consist of any such individual feature or step or combination of features and/or steps. In view of the foregoing description it will be evident to a person skilled in the art that various modifications may be made within the scope of the invention.

The invention claimed is:

1. A computer-implemented method comprising:

receiving first information indicative of a tracking device associated with a user being located in a particular place;

receiving, from a passive detector means, second information indicative of the user of the tracking device leaving said place or another person entering said place;

determining, based on the first and second information, that the user of the tracking device leaves or the other person enters said place, while the tracking device remains in said place;

further to said determining, causing at least one action to be performed.

2. The method of claim 1, wherein the receiving the first information comprises receiving information on whether the tracking device is connected to a charging station or wherein the receiving the first information comprises receiving information on whether the tracking device is sufficiently close to a first communications means located in the place to enable short-range communication or a signal of a predetermined strength.

3. The method of claim 1, wherein the at least one action comprises sending third information indicative of a result of said determining to at least one of: a server means, a communications device of a predetermined person other than the user of the tracking device, or a communications device of the user or wherein the at least one action comprises one or both of: causing a speaker to generate a sound audible to the user; causing a light to illuminate that is visible to the user.

4. The method of claim 1, further comprising, when the user comes into the place from outside with the tracking device, indicating to the user that the tracking device should be connected to a charging means.

5. The method of claim 1, wherein the receiving of the second information comprises receiving first signature information indicative of a first stored signature corresponding to an acoustic signal having been collected indicative of a first event and/or wherein the receiving of the second information further comprises receiving second signature information indicative of a second stored signature corresponding to a sound having been collected indicative of a second event.

6. The method of claim 5, further comprising determining, based on the receiving of the first and second signature information, that a sequence of signature information has been received; wherein the determining that a user of the tracking device leaves said place or the other person has entered while the tracking device remains in said place is dependent on the determining of the sequence.

7. The method of claim 6, further comprising, in response to determining that a user of the tracking device leaves or the other person enters said place while the tracking device remains in said place, activating an alert state, and if, after a predetermined period the alert state has not expired, causing the at least one action to be performed.

8. The method of claim 7, further comprising determining before the predetermined period has expired that the alert state is to be cancelled, and cancelling the alert state and/or further comprising, after the determining that a user of the tracking device leaves or another person enters said place while the tracking device remains in said place:

receiving at least one further signature information indicative of at least one further stored signature corresponding to at least one sound having been collected indicative of a third event;

determining that the alert state should be cancelled based on the received at least one further signature information.

9. The method of claim 8, further comprising determining, based on the receiving of the further signature information, that a further sequence of signature info nation has been received; wherein the determining that the alert state should be cancelled is based on the determine further sequence.

10. The method of claim 5, further comprising:

receiving, from a communications device separate to the tracking device, first acceleration information corresponding temporally with the collected sound from which the first signature information derives;

determining, dependent on the first acceleration information, whether the first event and the acceleration information are compatible;

determining that a user of the tracking device leaves or the other person enters said place while the tracking device remains in said place dependent on if the first event and the first acceleration information are compatible.

11. The method of claim 10, further comprising:

receiving, from a communications device separate to the tracking device, second acceleration information corresponding temporally with the collected sound from which the second signature information derives;

determining, dependent on the second acceleration information, whether the second event and the second acceleration information are compatible;

determining that a user of the tracking device leaves or they other person enters said place while the tracking device remains in said place dependent on if the second event and the second acceleration information are compatible.

12. The method of claim 1, further comprising processing collected sound using a low-pass filtering system and/or further comprising:

processing collected sound to generate acoustic signatures;

comparing said acoustic signatures with stored signatures to identify matches.

13. Apparatus comprising:

a controller means configured to:

receive first information indicative of a tracking device being located in a particular place;

receive, from a passive detector means, second information indicative of a user of the tracking device leaving said place or another person entering said place;

determine, based on the first and second information, that a user of the tracking device leaves said place or the other person enters said place, while the tracking device remains in said place;

further to said determining, cause at least one action to be performed.

14. The apparatus of claim 13, further comprising:

a charging station, wherein the first information is indicative of the tracking device being located connected to the charging station and/or wherein the tracking device is configured to provide location information indicative of the location of the tracking device to a server using a cellular communications network.

15. The apparatus of claim 13, further comprising at least one acoustic monitor means for collecting environmental sound, generating the second information based on the collected sound, and seconding the second information to the controller means.

16. The apparatus of claim 15, wherein the at least one acoustic monitor means is configured to convert said collected sound into electrical signals, and comprising a low-pass filtering means to reduce the bandwidth of the sound, and/or wherein the at least one acoustic monitor means is configured to generate acoustic signatures based on collected sound, wherein the second information is dependent on the acoustic signatures.

17. The apparatus of claim 16, wherein the at least one acoustic monitor means is configured to compare generated acoustic signatures with stored signatures, wherein the second information is indicative of stored signatures against which acoustic signatures have been matched.

18. The apparatus of claim 15, wherein the at least one acoustic monitor is configured to communicate with the controller means over mains electricity cables or wherein the at least one acoustic monitor and the controller means each have radio frequency transceivers to enable communication therebetween and/or wherein the communications device is further configured to generate location data indicative of the location of the communications device and to send the location data to the tracking device or to a remote server.

19. The apparatus of claim 13, wherein the tracking device includes an accelerometer, wherein received second information can be validated by comparison against acceleration information received from the accelerometer or the apparatus further comprising a personal, portable communications device separate to the tracking device and carried by the user, wherein the communications device includes an accelerometer means and is configured to provide acceleration information to the controller means, wherein the controller means is further configured to compare the acceleration information received from the accelerometer means with received second information so as to validate the received second information.

20. A computer program comprising computer program code stored on a non-transitory computer readable storage medium, which, when executed by a processing means, is configured to perform the steps of claim 1.

* * * * *